US006676053B2

(12) United States Patent
Cook

(10) Patent No.: US 6,676,053 B2
(45) Date of Patent: Jan. 13, 2004

(54) PAPER SHREDDER

(76) Inventor: James Stephen Cook, 35 Baker Street, Stouffville, Ontario (CA), L4A 5Z4

( * ) Notice: Subject to any disclaimer, the term of this patent is extended or adjusted under 35 U.S.C. 154(b) by 10 days.

(21) Appl. No.: 09/820,968

(22) Filed: Mar. 30, 2001

(65) Prior Publication Data

US 2002/0139883 A1 Oct. 3, 2002

(51) Int. Cl.[7] ..... B02C 18/16
(52) U.S. Cl. ..... 241/223; 241/243; 493/967
(58) Field of Search ..... 241/157, 185.5, 241/243, 293, 223; 493/967, 369, 370

(56) References Cited

U.S. PATENT DOCUMENTS 2,077,228 A * 4/1937 Bethune ..... 241/46.01
3,217,988 A * 11/1965 Lightfoot et al. ..... 241/243
3,353,754 A * 11/1967 Heijnis et al. ..... 241/243
3,545,686 A * 12/1970 Brown ..... 241/243
3,545,689 A * 12/1970 Luscombe ..... 241/186.4
3,762,256 A * 10/1973 Frantz ..... 241/190
4,200,239 A * 4/1980 Simone et al. ..... 241/222
4,226,372 A * 10/1980 Wigand ..... 241/160
4,608,895 A * 9/1986 Bell et al. ..... 83/345
5,173,352 A 12/1992 Parker ..... 428/174
5,403,259 A 4/1995 Parker ..... 493/352
5,910,079 A * 6/1999 Watanabe ..... 493/352

* cited by examiner

*Primary Examiner*—Mark Rosenbaum
(74) *Attorney, Agent, or Firm*—Nancy E. Hill; Hill & Schumacher

(57) ABSTRACT

A paper shredder for cutting sheet material includes a first and second blade and a sheet feeding assembly. The first blade has a cutting edge along one side thereof and the cutting edge has a non-straight profile. The second blade has a cutting edge that meshes with the cutting edge of the first blade and the first and second blades are movable relative to each other. The sheet feeding assembly moves the sheet material towards the first and second blade such that the direction of motion is generally orthogonal to each cutting edge. The cutting edge profile may have a variety of shapes, including a zig zag, a wave or a combination thereof. The paper shredder is used for making packing material that includes a plurality of pieces of shredded generally planar sheet material, each piece having two elongate outside edges with non-straight profiles.

12 Claims, 6 Drawing Sheets

PAPER SHREDDER

FIELD OF THE INVENTION

This invention relates to paper shredders and in particular paper shredders that produce paper having different shapes or edge profiles.

BACKGROUND OF THE INVENTION

Packaging of items is particularly important in the retail market. In particular it is important to have a packing material that both protects the product and looks attractive. Historically products were packaged and sold in boxes and they were packed with tissue paper or other packing material. More recently, open gift boxes, gift bags and gift baskets have become popular and the aesthetic appearance of the packaging material used therein has gained importance.

Shredded paper is well know as a packing material, particularly with open gift boxes, gift bags and gift baskets. More recently shredded paper that is folded or crimped has been used and has been suggested as an alternative to flat shredded paper. The advantage of the folded shredded paper over the flat shredded paper is that generally less paper is used during packing process. In addition the folded shredded paper is advantageous in regard to gift bags because it provides interest in regard to the presentation or the aesthetic appeal of the gift item. This is particularly advantageous in regard to a gift bag or a gift basket.

Folded shredded paper, however, has been available in the retail gift market for approximately ten years. Specifically one of the early patents for folded shredded paper, namely U.S. Pat. No. 5,173,352 issued to Parker on Dec. 22, 1992, was filed on Jun. 14, 1990. Although much work has been done to streamline the process for producing folded shredded paper, few new alternatives have been suggested, particularly alternatives that would be of interest to retail packages.

Particularly in the retail market it is important to have a packaging product that can be distinctive to a specific retailer. This may be done either by the colours that are used or by the shape that are used. With the exception of folded shredded paper heretofore shredded paper with different shapes or edge profiles was not available. Accordingly it is advantageous to provide shredded paper that has different shapes or edge profiles.

SUMMARY OF THE INVENTION

The present invention is a paper shredder for cutting sheet material and it includes a first and second blade, and a sheet feeding assembly. The first blade has a cutting edge along one side thereof and the cutting edge has a non-straight profile. The second blade has a cutting edge that meshes with the cutting edge of the first blade and the first and second blades are movable relative to each other. There is a mechanism for moving the first and second blade, relative to each other. The sheet feeding assembly moves the sheet material towards the first and second blade such that the direction of motion is generally orthogonal to each cutting edge. The paper shredder may include a plurality of rotating blades. The cutting edge profile may have a variety of shapes, including a zig zag, a wave or a combination thereof.

Another aspect of the invention is packing material that includes a plurality of pieces of shredded generally planar sheet material. Each piece has two elongate outside edges with non-straight profiles. The edge profiles may have a variety of shapes including zig zag, waves or a combination thereof.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
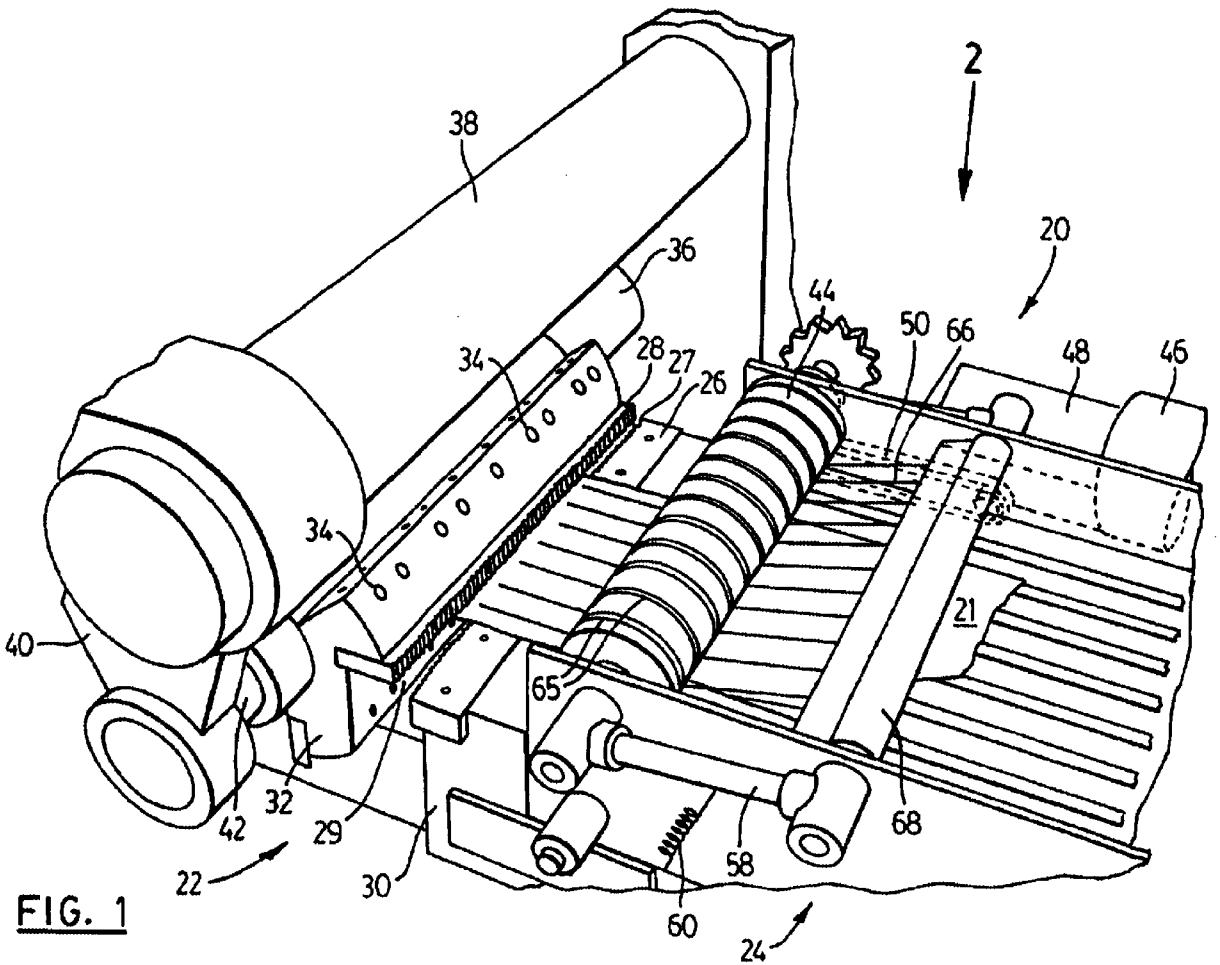
FIG. 1 is a perspective view of the paper shredder constructed in accordance with the present invention.

Referring to FIG. 1, the paper shredder of the present invention is shown generally at 20 and is used for paper 21. The paper shredder includes a cutting assembly 22 and a paper feeder assembly 24. It will be appreciated by those skilled in the art that the paper shredder herein can be used for cutting paper or any other sheet material and for convenience it will be discussed in the context of paper with the understanding that its use is not limited to paper.

Figure 4:
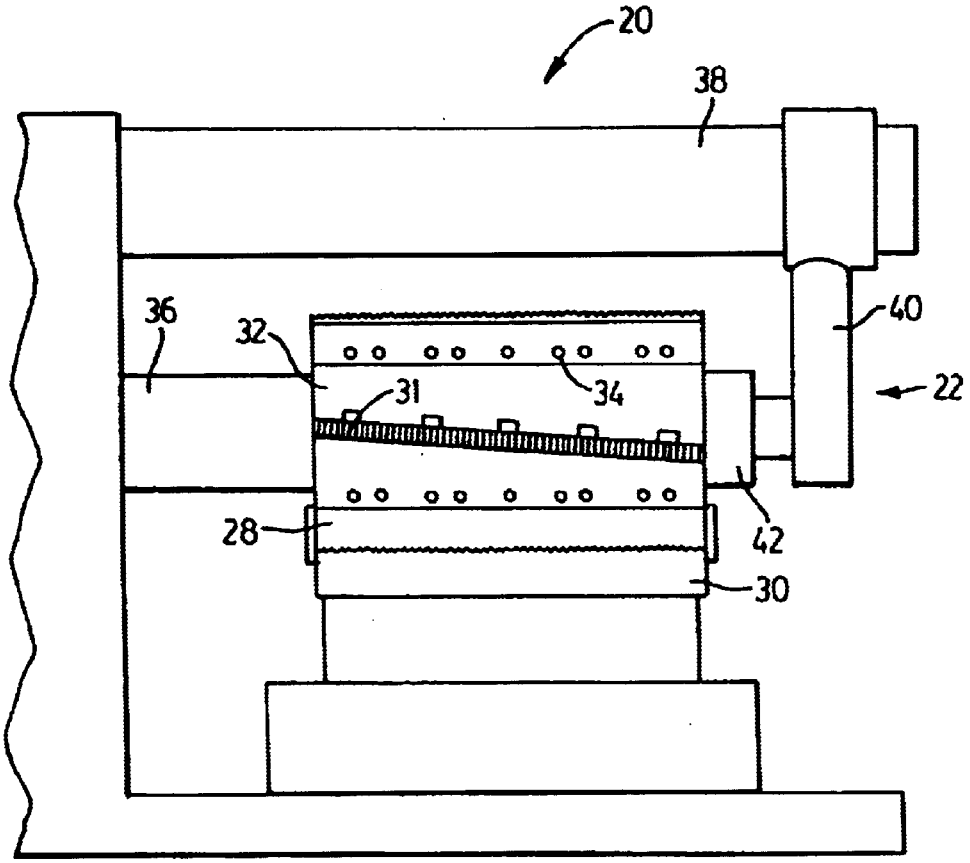
FIG. 4 is an end view of the paper shredder.

The cutting assembly 22 includes a stationary blade 26 and a movable blade 28. The stationary blade 26 has a cutting edge 27 that has a non-straight profile. The movable or rotating blade 28 has a cutting edge 29 that is a mirror image of the stationary blade cutting edge 27 such that when they are brought together they mesh. Stationary blade 26 is attached to a stationary blade holder 30. Preferably there are a plurality of movable blades 28 attached to a rotating blade holder 32. The rotating blade holder 32 includes alignment pins 34 to help align rotating blades 28 when the cutting assembly 22 is being set up and during use. Each movable blade 28 is attached with bolts 31 such that each is on an angle relative to the station blade 26, as best seen in FIG. 4. This helps to facilitate the cutting so that the cutting starts at one side of the blades 26, 28 and proceeds to the other side of the blades, as rotating blade 28 rotates.

The cutting assembly 22 herein has a drive (not shown) on one side 36 of the rotating blade holder 32. A pair of steady bars 38 extend above the rotating blade holder 32. A bearing block 40 extends downwardly from each distal end of the steady bars 38 and supports the other side 42 of rotating blade holder 32. The steady bars 38 and bearing block 40 provide support for the other side 42 of rotating blade holder 32.

Figure 2:
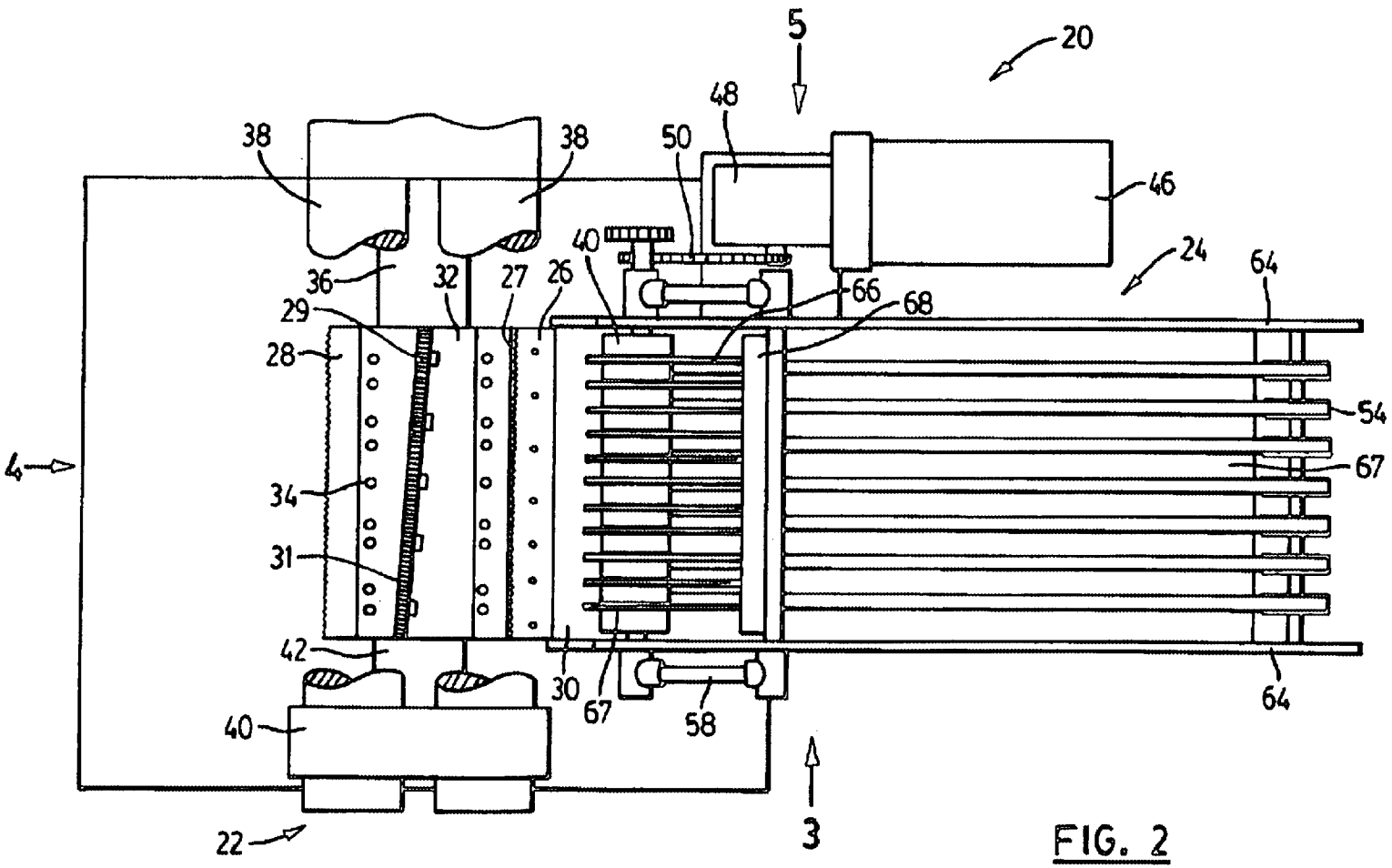
FIG. 2 is a top view of the paper shredder
Figure 3:
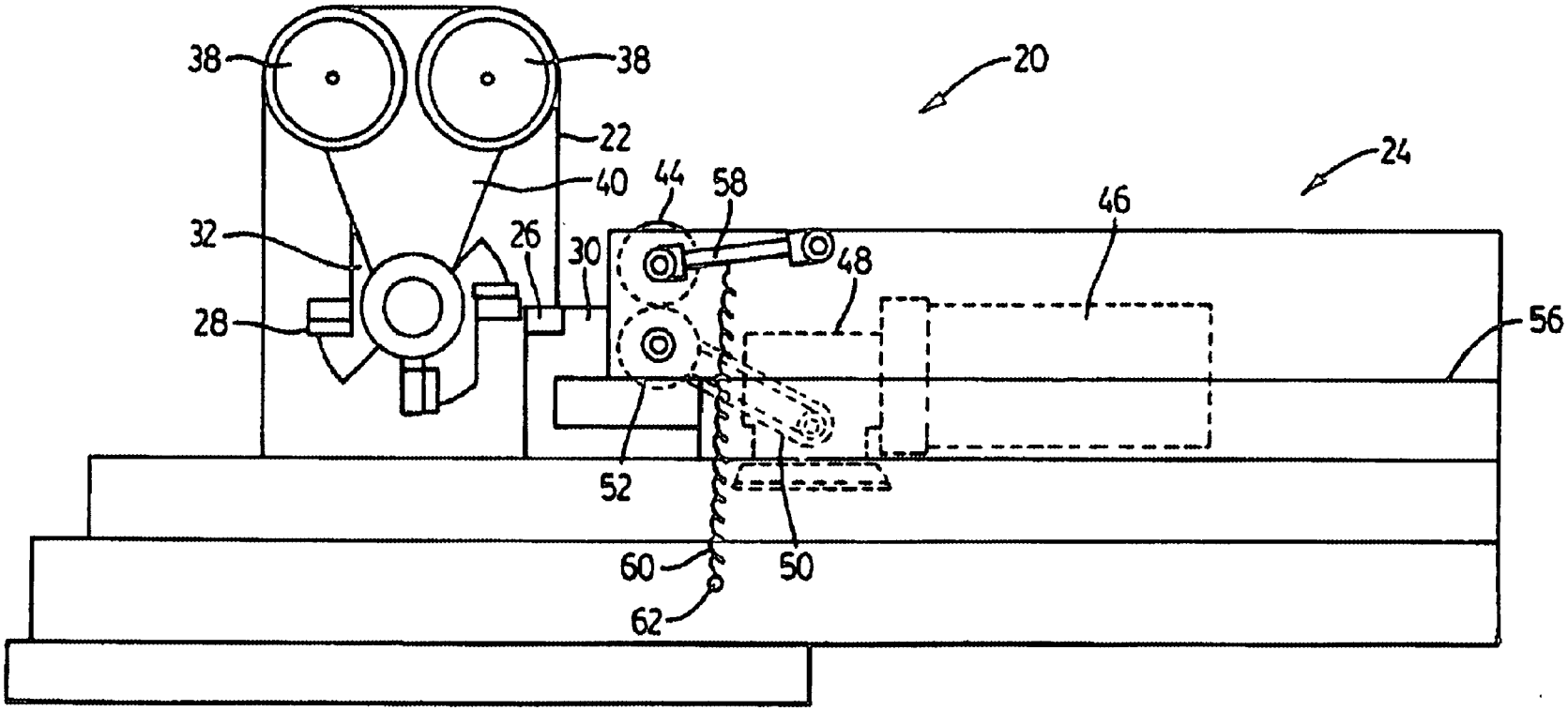
FIG. 3 is a side view of the paper shredder.
Figure 5:
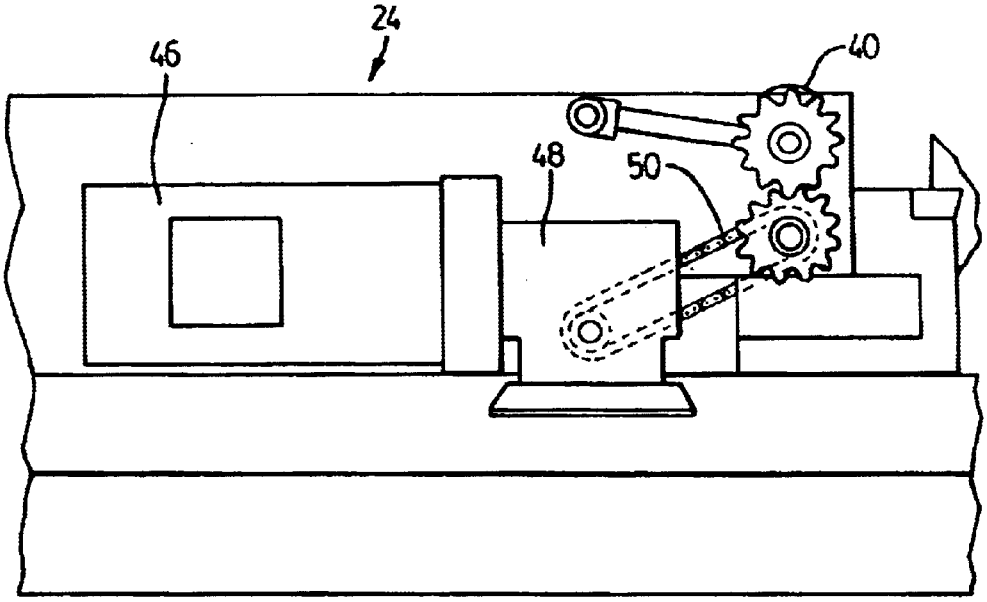
FIG. 5 is a side view of the paper shredder.

Referring to FIGS. 2, 3 and 5, the paper feeder assembly 24 generally feeds the paper such that the direction of motion is orthogonal to the blades 26, 28 of the cutting assembly 22. Paper feeder assembly 24 includes a feed roller 44 operably attached to a variable speed motor 46. Reduction gears 48 are connected to the motor 46. A feed drive chain 50 is connected between the reduction gears 48 and feed roller 44. Feed roller 44 engages feed belt roller 52. A plurality of feed belts 54 (best seen in FIG. 2) extend around feed table 56 and are driven by feed belt roller 52. A feed roller tensioning device 58 in conjunction with tension spring 60 help to maintain tension on feed roller 44. Tension spring 60 is held in place with bolt 62.

Paper feed table 56 has a pair of paper limit guides 64 arranged on either side of the paper feed table 56. A plurality of anti bunching combs 66 extend downwardly from a comb bar 68 which is spaced above paper feed table 56. Combs 66 extend between feed roller 44 and feed belt roller 52. Feed roller 44 has a plurality of circumferential grooves 65 formed therein for receiving the combs 66. Combs 66 may extend outwardly from the feed roller 44 toward the stationary blade 26 but end before the cutting edge thereof. Anti bunching combs 66 help to keep paper in position. Paper feed table 56 may include a lateral cutting blade 67 (shown in FIG. 2) which extend upwardly from the table and cuts the sheet material 21 as it is fed along the feed table 56. One cutting blade 67 is shown herein but a plurality of blade may also be used.

Figure 6:
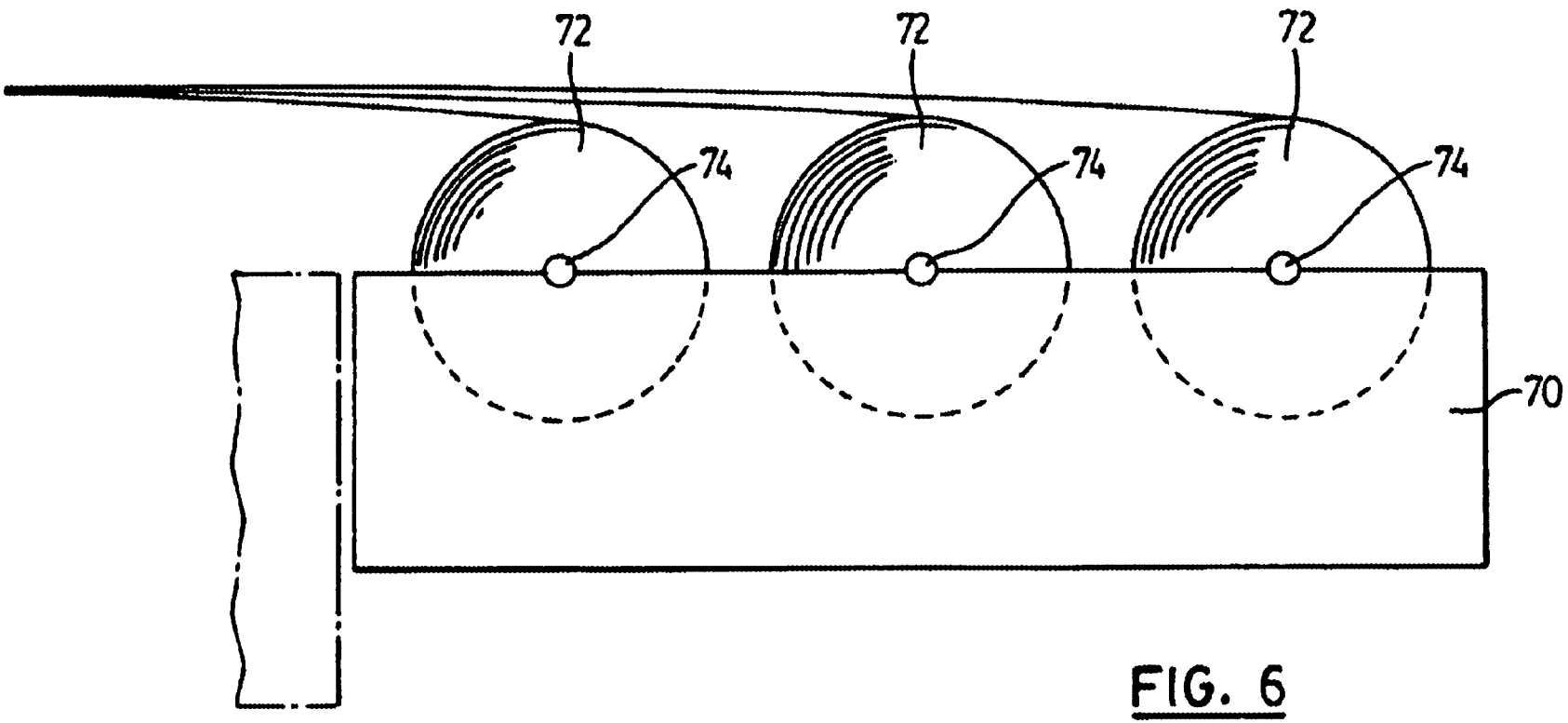
FIG. 6 is a side view of a paper roll stand for providing inputs into the paper shredder.

Referring to FIG. 6 paper that is being fed into the paper shredder 20 is held in a paper roll stand 70. A plurality of paper rolls 72 may be held in the stand 70. Each paper roll 72 has a shaft 74 that is held in position in the stand 70. A plurality of paper rolls 72 increases the throughput of the paper shredder 20. Further, it allows the user to create multicolour shredder paper wherein the colours are well mixed. It will be appreciated by those skilled in the art that further variations to the aesthetic look of the shredder paper may be achieved by varying the paper input. For example one roll may be a metallic or foil paper. Alternatively the shredder material may be plastic, mylar or the like.

Figure 7:
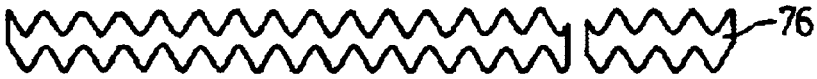
FIG. 7 is a top view of a shredded piece of paper having a zig zag edge profile made in the paper shredder of the present invention.
Figure 8:
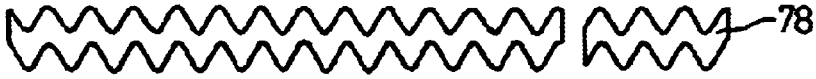
FIG. 8 is a top view of an alternate embodiment of a shredded piece of paper having an elongate zig zag edge profile made in the paper shredder of the present invention.
Figure 9:
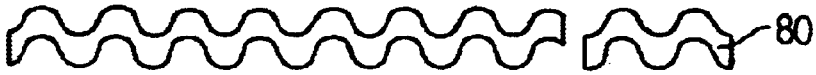
FIG. 9 is a top view of a third alternate embodiment of a shredded piece of paper having a wave edge profile made in the paper shredder of the present invention.
Figure 10:
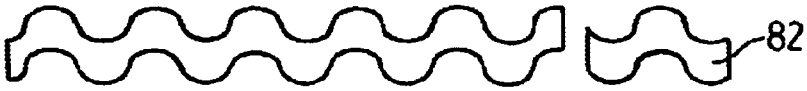
FIG. 10 is a top view of a fourth alternate embodiment of a shredded piece of paper having an elongate edge profile made in the paper shredder of the present invention.
Figure 11:
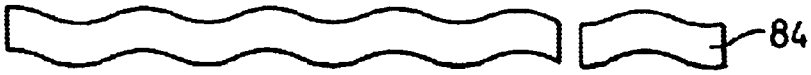
FIG. 11 is a top view of a fifth alternate embodiment of a shredded piece of paper having an extended elongate edge profile made in the paper shredder of the present invention.
Figure 12:
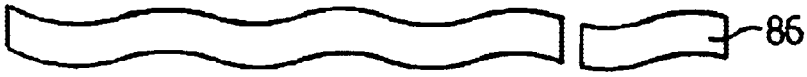
FIG. 12 is a top view of a sixth alternate embodiment of a shredded piece of paper having a very extended elongate wave edge profile made in the paper shredder of the present invention.
Figure 13:
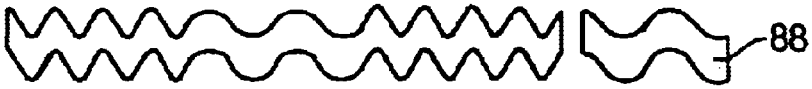
FIG. 13 is a top view of a seventh alternate embodiment of a shredded piece of paper having a combination zig zag and wave edge profile made in the paper shredder of the present invention.

Referring to FIGS. 7 through 13 it will be evident to those skilled in the art that a wide variety of different shapes or edge profiles may be achieved by using the paper shredder of the present invention. Each different shape has two edges that have the same profile that is spaced apart. Typically the remaining piece of shredded paper is 1/32 to 1/2 inch wide and preferably it is 1/8 inch wide. Some examples of different profiles are shown herein but the user can choose from these or choose others and still be within the scope of this invention. FIG. 7 shows a shredded piece of paper 76 having a zig zag edge profile. FIG. 8 shows a shredded piece of paper 78 having an elongate zig zag edge profile. FIG. 9 shows a shredded piece of paper 80 having a wave edge profile. FIG. 10 shows a shredded piece of paper 82 having an elongate edge profile. FIG. 11 shows a shredded piece of paper 84 having an extended elongate edge profile. FIG. 12 shows a shredded piece of paper 86 having a very extended elongate wave edge profile. FIG. 13 shows a shredded piece of paper 88 having a combination zig zag and wave edge profile. A plurality of shredded pieces of paper together form a packing product. The shredded pieces of paper tend to catch on each other to form a resilient packing product. It has been found that the amount of paper used to pack an object is less when the shredded paper of the present invention is used as compared to straight shredded paper.

It will be appreciated by those skilled in the art that there are number of variations that could be made to the paper shredder described above. For example the movable blade 28 could be arranged in a guillotine type arrangement with the movable blade moving up and down at a predetermined rate. Alternatively both blades could be movable. In a further alternative the shredded pieces may be made by way of die cut. Further, it will be appreciated that the paper shredder herein has been described in association with paper but it could be used with any sheet material.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A shredder for cutting sheet material and producing packaging product having a plurality of strips each with two elongate outside edges with non-straight profiles comprising:

a first blade having a cutting edge along one side thereof, the cutting edge having a non-straight profile;

a second blade having a cutting edge that meshes with the cutting edge of the first blade wherein the first and second blades are movable relative to each other and the second blade is on an angle relative to the first blade when it meshes therewith;

a means for moving the first and second blade relative to each other, and a sheet feeding assembly for moving the sheet material towards the first and second blade in a direction of motion which is generally orthogonal to each cutting edge and in a manner such that the sheet material is cut into a quantity of strips each with two elongate outside edges with non-straight profiles.

2. A shredder as claimed in claim 1 wherein the first blade is a stationary blade and the second blade is a movable blade.

3. A paper shredder as claimed in claim 2 wherein the second blade is attached to a rotating blade holder.

4. A shredder as claimed in claim 3 wherein there are a plurality of rotating second blades attached to the rotating blade holder.

5. A shredder as claimed in claim 4 further including a sheet roll stand proximate to the sheet feeding assembly that holds a plurality of sheet rolls each and whereby sheet on a sheet roll is fed into the sheet feeding assembly.

6. A shredder as claimed in claim 4 wherein the sheet feeding assembly includes a sheet table and further including a cutting blade extending upwardly from the sheet table arranged to cut sheet in the direction of motion.

7. A shredder as claimed in claim 4 wherein the first blade cutting edge has a zig zag profile.

8. A shredder as claimed in claim 4 wherein the first blade cutting edge has a wave profile.

9. A shredder as claimed in claim 4 wherein the first blade cutting edge has a combination zig zag and wave profile.

10. A shredder as claimed in claim 1 wherein the first blade cutting edge has a zig zag profile.

11. A shredder as claimed in claim 1 wherein the first blade cutting edge has a wave profile.

12. A shredder as claimed in claim 1 wherein the first blade cutting edge has a combination zig zag and wave profile.

* * * * *